US005196878A

United States Patent [19]

Muller et al.

[11] Patent Number: 5,196,878

[45] Date of Patent: Mar. 23, 1993

[54] PROCESSOR FOR PHOTOSENSITIVE MATERIAL

[75] Inventors: Bruce R. Muller, Rochester; David G. Sherburne, Ontario; Douglas O. Hall, Canandaigua, all of N.Y.

[73] Assignee: Eastman Kodak Company, Rochester, N.Y.

[21] Appl. No.: 766,375

[22] Filed: Sep. 27, 1991

[51] Int. Cl.[5] ..... G03D 13/00

[52] U.S. Cl. ..... 354/299; 354/324

[58] Field of Search ..... 354/298, 299, 319-324, 354/317

[56] References Cited

U.S. PATENT DOCUMENTS

| | | | |
|---|---|---|---|
| 1,772,834 | 8/1930 | Hopkins | 354/299 |
| 3,613,547 | 10/1971 | Snarr et al. | 354/299 |
| 4,754,298 | 6/1988 | Nishimoto | 354/299 |
| 4,937,608 | 6/1990 | Ishikawa et al. | 354/324 |
| 4,994,840 | 2/1991 | Hall et al. | 354/324 |
| 4,995,913 | 2/1991 | Juers | 134/13 |
| 5,023,643 | 6/1991 | Lynch et al. | 354/299 |
| 5,027,145 | 6/1991 | Samuels | 354/324 X |

*Primary Examiner*—Michael L. Gellner
*Assistant Examiner*—D. Rutledge
*Attorney, Agent, or Firm*—Frank Pincelli

[57] ABSTRACT

A pump circulates water from a wash-water chamber to a diverter valve where it can be directed either to a heat exchanger in a processing fluid chamber or directly back to the water chamber. The temperature of the processing fluid is detected by a sensor, and a microprocessor controls the diverter valve as a function of the temperature detected by the sensor in order to maintain the temperature of the processing fluid at a desired set point. The water temperature increases over a period of time, and may reach a level where the desired set point temperature cannot be maintained. If this occurs, the microprocessor opens a valve to a building water supply to add fresh, cool water to the water chamber.

5 Claims, 3 Drawing Sheets

FIG. 1
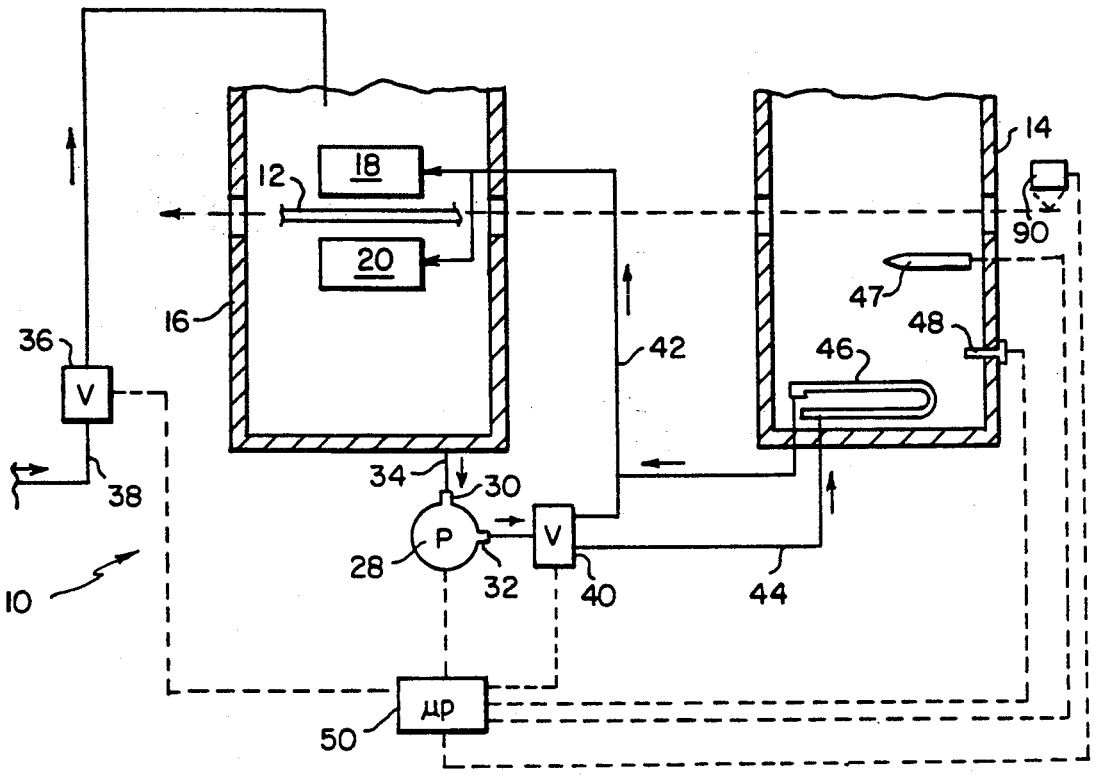
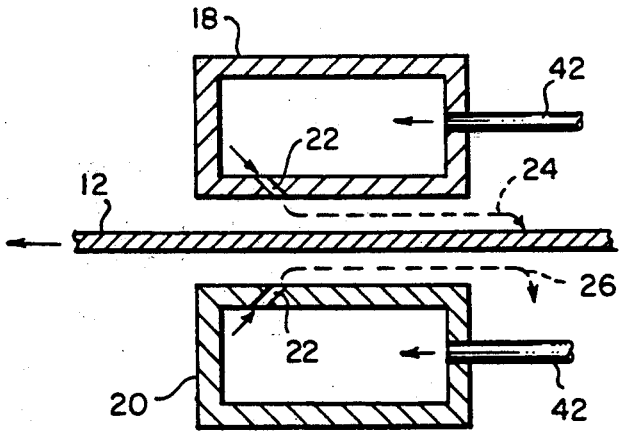
FIG.2

PROCESSOR FOR PHOTOSENSITIVE MATERIAL

BACKGROUND OF THE INVENTION

This invention relates to a processor for photosensitive material, such as x-ray film, wherein the temperature of a processing fluid is controlled by circulation of water from a wash chamber.

The processing apparatus as disclosed in U.S. Pat. No. 4,994,840, issued Feb. 19, 1991, has a plurality of processing units to which processing fluid is supplied. Each unit has a sump that retains the fluid, and a series of processing devices referred to as a fluid suspension processor. The processing device has upper and lower housings located to define a fluid chamber through which film sheets or strips are advanced during processing operation. As the film travels through the chamber, processing fluid is directed against opposite sides of the film for processing the film, and the processing fluid is returned to the sump.

It is common for film processors to receive water for a wash tank of the processor directly from the water supply provided to the building. Some disadvantages result from using the building water supply. For example, the incoming water temperature can vary over a wide range of temperatures, such as about 40° to 90° F. (4.5° to 32° C.), and cold water at the lower end of this temperature range does not wash effectively. Also, the water supply may be turned on any time film is being processed, and this results in excessive use of water. Furthermore, the water supply may be turned on whenever cooling of a fluid is required, thereby wasting water. In addition, a relatively large quantity of water may be necessary for cooling purposes, such as 1-3 gallons per minute.

It also is known to maintain the temperature of the developer fluid in a film processor at a relatively high temperature, for example, about 95° F., in order to improve the developing operation and reduce the time required for development of the film. In order to maintain the desired temperature of the developer, a heat exchanger may be provided in the developer for cooling the developer if it exceeds the desired temperature for the developer fluid.

SUMMARY OF THE INVENTION

Accordingly, it is an object of the invention to provide an improved processing apparatus wherein the wash water is heated by the developer solution, the temperature of a processing solution is accurately controlled by the wash water, and wherein only a low quantity of water from a building supply is required periodically.

In accordance with the present invention, wash water is recirculated from a wash chamber of a processor and applied to a sheet or strip of film for washing the film. When the temperature of the processing solution exceeds a predetermined value, the wash water is diverted into a heat exchanger in the solution for cooling its developer, thereby warming the wash water before it is subsequently provided to the film. In the event the wash water reaches a high enough temperature so that the solution cannot be cooled sufficiently, then low quantities of water from a building supply are added to the water in the wash chamber for cooling such water and thereby increasing its effectiveness for cooling the solution.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which:

FIG. 1 is a schematic view of film processing apparatus incorporating the invention;

FIG. 2 is an enlarged fragmentary view of a portion of the wash system for the film;

DETAILED DESCRIPTION OF THE PREFERRED EMBODIMENT

Figure 3:
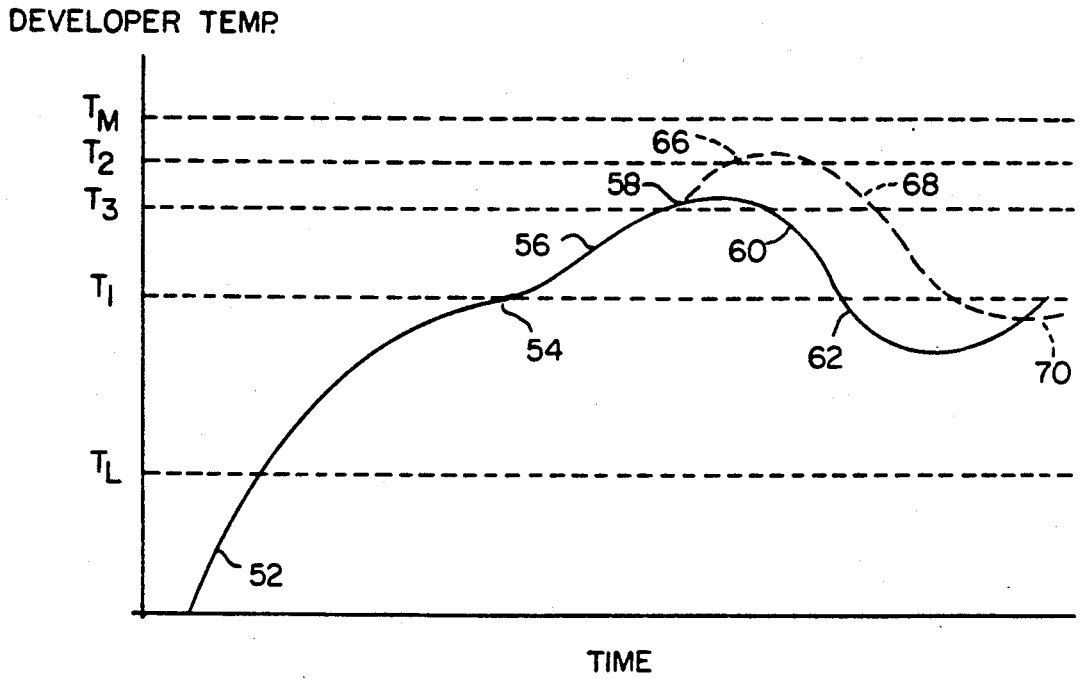
FIG. 3 is a graph illustrating the relationship between the developer temperature and the time during a typical period of operation of the apparatus of the invention.

The processing apparatus of the invention can be used with various kinds of processors, including a process of the kind disclosed in the before-mentioned U.S. Pat. No. 4,994,840. In FIG. 1 of the drawings, a portion of such a processor is generally designated 10 and can be used for processing photosensitive materials of various kinds, such as photographic film or paper, and the photographic materials can be in sheet or strip form. By way of example, the processor can be used for processing sheets of x-ray film designated 12 in FIGS. 1 and 2.

In the following description, reference is made to controlling the temperature of developer in a processor. However, it will be understood that the temperature control system is also applicable to other fluids, such as fixer solutions.

Processor 10 includes a plurality of chambers for holding processor materials, such as developer, fixer and wash solutions. In FIG. 1, two such chambers are illustrated, including a chamber 14 for holding the developer solution and a chamber 16 for a wash solution, such as water. The other chambers of the processor have been omitted for clarity.

As best illustrated in FIGS. 1 and 2, wash chamber 16 contains a pair of tubes 18,20 which extend substantially entirely across the width of the chamber on opposite sides of the path for the film 12. The tubes are preferably rectangular in cross section as illustrated in the drawings, with the lower surface of tube 18 being immediately above the film 12, while the upper surface of tube 20 is immediately below the surface of film 12. Tubes 18,20 each have openings 22 in the surfaces thereof adjacent to the film path. When wash water is introduced into the tubes 18,20 it flows through the openings 22 and engages both surfaces of the film 12 for washing the surfaces. As illustrated in FIG. 2, preferably the openings 22 are disposed at an angle with respect to the film path so that water leaving the openings travels along paths 24,26 over the surface of the film and in a direction which is opposite to the direction of movement of the film. However, the openings can be disposed so that the water travels in the same direction as the film. Openings 22 can comprise a plurality of spaced apertures or may comprise an elongate, continuous slot. After washing the film, the water enters chamber 16 and can be recirculated, as explained later.

Tubes 18,20 are large enough in cross section to keep the flow of water against the film in contact with the film and to maintain a high velocity flow at the film plane. This high velocity keeps the boundary layer of water at the film relatively thin which improves washing of the film as compared to conventional wash systems using sprays or having baths through which the film is circulated. Because the effectiveness of the washing action is improved, the film path length through the chamber 16 can be decreased and the amount of water used for washing can be decreased.

A solenoid operated valve 36 controls flow of water through a conduit 38 to chamber 16 from a building supply, or other source. Water is furnished to chamber 16 through conduit 38 to initially fill the chamber, to add a small quantity of water to the chamber 16 each time a sheet is processed, and to add relatively cool water to the chamber, as explained later.

A pump 28 has an inlet 30 and an outlet 32. The inlet is connected to the bottom of chamber 16 through a conduit shown diagrammatically at 34. Outlet 32 of the pump is connected to an inlet of an electrically operated diverter valve 40. Valve 40 has two outlets, one of which is connected by a conduit shown diagrammatically at 42 to each of the tubes 18,20. Valve 40 has another outlet connected through a conduit 44 to the inlet end of a heat exchanger 46 located in the developer chamber 14. The outlet of the heat exchanger is connected to the conduit 42 between the valve 40 and the tubes 18,20. When the diverter valve is in one of its two positions, water delivered by pump 28 is directed into conduit 42 so that the heat exchanger is bypassed and water is provided directly to the tubes 18,20 and the wash chamber. On the other hand, when the valve 40 is in its second position, water from pump 28 is directed through conduit 44 to the heat exchanger 46, and then it flows into the conduit 42 to tubes 18,20 and the wash chamber. This cools the developer and warms the wash water.

A heating element 47 in chamber 14 heats developer to its operating temperature. A temperature sensor 48 is located in chamber 14 for detecting the temperature of developer fluid in the chamber. Sensor 48 may comprise a thermistor, for example.

A microprocessor 50 is used for controlling operation of the processor 10. As illustrated in FIG. 1, the microprocessor is connected to pump 28, solenoid operated valve 36, the diverter valve 40, heating element 47 and to the sensor 48 so that it can sense the temperature of the developer fluid in chamber 14 and operate valves 36,40 and pump 28 in a predetermined, programmed sequence. The programmed sequence of operation is best understood by reference to FIGS. 3 and 4 of the drawings.

In FIG. 3 of the drawings, the temperature $T_1$ represents the set point temperature for the developer solution, i.e., the desired operating temperature. The set point temperature may vary based upon a number of known factors, such as the kind of film being processed, the processor time cycle, etc. By way of example, $T_1$ may be a temperature of 95° F. (35° C.). $T_L$ and $T_M$ represent the minimum and maximum desired temperature, respectively, for operation of the processor. Again, $T_L$ and $T_M$ may vary; however, by way of example, $T_L$ may be approximately 0.5° F. (0.2° C.) below the set point temperature $T_1$ and $T_M$ may be approximately 0.5° F. (0.2° C.) above the set point temperature.

When the processor is initially turned on, the microprocessor will interrogate the sensor 48 to determine the temperature of developer fluid in the chamber 14. When the processor has been shut down for a long period of time, the processing fluid temperature may be below the minimum temperature $T_L$ required for operation of the processor. Accordingly, the microprocessor will turn on the heater 47 in the developer chamber 14 and a warning light will signal the operator that the developer station is not yet ready for operation. Gradually the temperature increases until it reaches the minimum temperature $T_L$ required for operation, as indicated in the lower left portion of FIG. 3 at 52. Once the temperature $T_L$ is reached, the warning light is extinguished and, if other portions of the processor are ready for operation, a "ready" light will signal the operator that the processor is ready for operation. At this time, the diverter valve 40 is set to direct wash water into conduit 42.

The heater in the processing chamber will continue to operate until the temperature reaches the set point temperature $T_1$. At this point the microprocessor will shut off the heater and the developer temperature will remain relatively constant at temperature $T_1$, as indicated at 54 in FIG. 3.

After a period of time, the temperature of the developer may gradually increase, as indicated at 56 in FIG. 3. This increase in temperature can occur, for example, as a result of heat in the ambient atmosphere in the area of the developer chamber 14. Heat is generated in the area of chamber 14 by the dryer section of the processor, for example. If the temperature of the developer fluid increases to temperature $T_3$, as shown at 58 in FIG. 3, the microprocessor 50 switches the diverter valve 40 so that water leaving pump 28 is diverted into conduit 44 and circulated through the heat exchanger 46 before it passes through conduit 42 to the wash tubes 18,20. The wash water is normally cooler than the developer temperature, thereby cooling the developer in chamber 14, as shown at 60 in FIG. 3.

When the microprocessor senses that the temperature of the developer fluid is below the set point temperature $T_1$, as indicated at 62, the microprocessor will send a signal to diverter valve 40 causing it to shut off the flow of water to conduit 44 and direct water from pump 28 into the conduit 42 for delivery to the wash tubes. Shutting off the cool wash water to the heat exchanger 46 will stop the decrease in the developer temperature, as indicated at 64. Thereafter the temperature of the developer may again rise due to the temperature of the ambient air in the area of the developer chamber 14 or due to heat supplied by heating element 47. Should the temperature reach temperature $T_3$ again, the diverter valve is adjusted by the microprocessor to supply cooling water to the heat exchanger to again lower the temperature to the set point. This cycling mode of operation can hold the temperature of the developer fluid very close to the set point temperature $T_1$. For example, the variations in developer temperature as shown in solid lines in FIG. 3 may be limited to approximately 0.25° F. (0.1° C.) above or below the set point temperature $T_1$.

When the wash water is circulated through the heat exchanger 46, it not only cools the temperature of the developer fluid, it also results in an increase in the temperature of the wash water. This is desirable because it is known that wash water is more effective to clean film when the water temperature is maintained at an elevated temperature. Thus, the system of the invention not only accurately controls the developer temperature to provide high quality processing of photographic film, it also improves the washing action of the water used for the cooling.

Because valve 40 is providing water to the heat exchanger, it is possible for the temperature of water circulated from chamber 16 through the heat exchanger 46 and back to the chamber 16 to gradually increase to a point where the water is ineffective to cool the developer fluid rapidly enough to maintain the temperature of the developer below temperature $T_3$ and at, or close to, the set point temperature $T_1$, as described above. When this condition occurs, the developer temperature may rise above the normal operating range and reach a temperature $T_2$ closely adjacent to the maximum temperature $T_M$, as shown in dotted lines at 66 in FIG. 3.

When the microprocessor receives a signal from sensor 48 indicating that temperature $T_2$ is exceeded, the microprocessor opens the valve 36 to provide fresh, cool water from the building supply to the wash chamber 16. Introduction of the cooler water into the chamber 16 decreases the temperature of the wash water flowing through conduit 34 to the pump and then through the heat exchanger. As a result, developer temperature decreases as shown at 68 in FIG. 3. When the temperature of the developer fluid reaches temperature $T_3$, the microprocessor closes valve 36 to shut off the supply of water from the building supply to the wash chamber 16. Also, when the developer temperature is below temperature $T_3$, the microprocessor sets the diverter valve 40 to bypass conduit 44 and the heat exchanger, thus allowing the developer temperature to stabilize at approximately the set point temperature $T_1$, as shown at 70.

Figure 4:
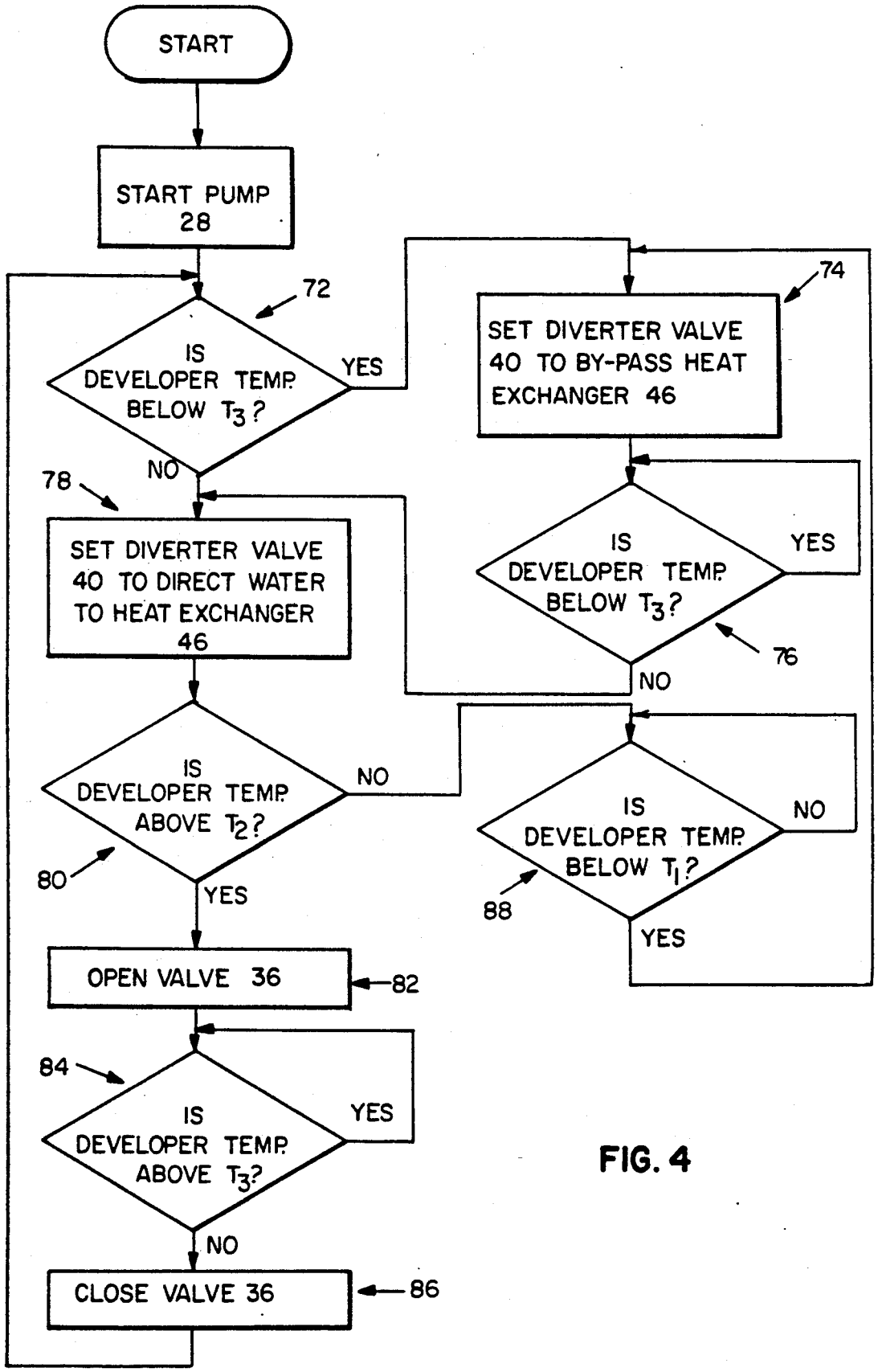
FIG. 4 is a flow chart illustrating the operation of the apparatus of the invention.

The flow diagram of FIG. 4 illustrates the method of operation previously described with respect to FIG. 3. Assuming the temperature is above $T_L$, or if washing of the film is required, pump 28 is started. Initially the system determines from sensor 48 whether the developer temperature is below temperature $T_3$, as indicated at 72 in FIG. 4. When the processor is being started after a long period of inactivity, such as in the morning, the developer temperature typically is below temperature $T_3$. Therefore, the diverter valve 40 is set to bypass the heat exchanger 46, as indicated at 74, and the microprocessor continues to determine whether the developer temperature is below temperature $T_3$, as indicated at 76. As long as the temperature is below $T_3$, the system waits for an increase in the temperature, and when temperature $T_3$ is reached, the diverter valve 40 is set to direct water to the heat exchanger 46, as indicated at 78.

In some circumstances, the system, when started, determines that the developer temperature is below $T_3$, as indicated by the block designated 72 in FIG. 4. This might occur, for example, after a long summer weekend when the ambient temperature in the building has exceeded the set point temperature, or when the processor has been shut down for a short period of time. In the event the developer temperature is not below $T_3$, when sensed at 72, then the diverter valve 40 is set to direct water to the heat exchanger 46 as shown at 78. After the diverter valve is directing water to the heat exchanger, the system continues to monitor the developer temperature to determine if it is above temperature $T_2$, as shown at 80. When it determines that the temperature is above $T_2$, then the microprocessor opens valve 36, as shown at 82, and the system monitors the developer temperature to determine if it is above temperature $T_3$, as shown at 84. If the temperature remains above $T_3$, the valve remains open and the temperature continues to be monitored as shown at 84. When the developer temperature is no longer above $T_3$, the valve 36 is closed, as indicated at 86, and the system again monitors the developer temperature to determine if it is below $T_3$, as indicated at 72.

If monitoring of the developer temperature, as indicated at 80, shows that the temperature is not above $T_2$, then the system asks if the developer temperature is below $T_1$, as indicated at 88. If the temperature is not below $T_1$, the system simply continues to monitor the temperature. When the temperature falls below $T_1$, then the system again sets the diverter valve 40 to bypass the heat exchanger 46, as shown at 74.

As water is recirculated from chamber 16 to tubes 18,20, it washes film 12 clean of residual amounts of fixer solution or other material on the surface of the film. Over a period of time, the wash water could become contaminated in the process of cleaning the film even though fresh water is provided at times through valve 36 for cooling the water in order to control the temperature of developer in chamber 14. In order to avoid such contamination of the wash water and to keep the water fresh enough to wash the film, the microprocessor preferably open valve 36 for a period of time whenever film is processed. Thus, a film sensor 90 located adjacent the film path into chamber 40 detects the presence of film and provides a signal to the microprocessor. The microprocessor opens valve 36 for a predetermined period of time to replenish the water in chamber 16 with fresh water. Valve 36 can be opened immediately in response to sensing the film or at some other time in the cycle of operation of the processor for processing the film. If strips of photographic film or paper are being processed, then the microprocessor can open valve 36 at predetermined time intervals. Valve 36 can be opened only for a brief period of time in order to replenish the water, the time period being less than the period of time required to process the film. Thus, less water is required from the supply than in prior procedures wherein the water supply is open to supply water throughout a processing cycle.

A number of advantages are achieved by the system of the present invention. First of all, developer or other processing fluids are maintained at a desired set point with very little temperature fluctuation above or below the set point temperature. This improves the quality of the film processing operation. Also, the water used for cooling the processing fluid is warmed in the process of cooling the fluid, and warmer water is more effective in washing the film than cooler water. Also, recirculating the wash water in the manner described, and adding a small quantity of fresh water each time a sheet is processed, instead of using only a supply of water from a building supply, reduces the quantity of fresh water required for operation of the processor, thus reducing the cost by reducing the total amount of water used. Recirculation also reduces the amount of water discharged into a drain. When the system of the invention is used with a processor of the kind disclosed in the before-mentioned U.S. Pat. No. 4,994,840, very little water from the building supply is needed after the wash chamber 16 is initially filled. For example, the water added when the temperature exceeds $T_2$ can be as little as one liter per minute, or less.

While the invention has been described in connection with temperature control of a developer fluid, it will be understood that the invention is equally applicable to cooling of other kinds of fluid in a film processor, such as a fixer solution.

The invention has been described in detail with particular reference to a preferred embodiment thereof, but it will be understood that variations and modifications can be effected within the spirit and scope of the invention.

We claim:

1. In a processor for a photosensitive material, such as film, the processor having a plurality of chambers for processing the material including a first chamber for holding a processing fluid and a second chamber for holding water used for washing the material, a pump connected to the second chamber for removing water from the second chamber and recirculating the water to the second chamber, means for providing fresh water from a supply of such water to the second chamber, and a heat exchanger in the first chamber, the heat exchanger having an inlet and an outlet, the improvement comprising:

a diverter located between the outlet of the pump and the second chamber, the diverter having an inlet connected to the outlet of the pump and first and second outlets, the first outlet of the diverter being connected to the second chamber so that water from the pump can be provided directly to the second chamber, the second outlet of the diverter being connected to the inlet of the heat exchanger with the outlet of the heat exchanger being coupled to the second chamber, a temperature sensor located with respect to the first chamber for detecting the temperature of the processing fluid in the chamber, and a processor control for positioning the diverter (1) to recirculate water from the second chamber through the pump and the first outlet of the diverter valve directly back to the second chamber when the sensor detects a fluid temperature in the first chamber below a first predetermined temperature, and (2) to position the diverter to circulate water from the second outlet of the diverter valve to the heat exchanger when the sensor detects a developer temperature above the minimum temperature to effect cooling of the fluid in the second chamber.

2. The invention as set forth in claim 1, wherein the means for providing fresh water from a supply to the second chamber comprises a conduit located between the supply and the second chamber, a supply valve for controlling the flow of water in such conduit, and the control means being operable to open the supply valve in response to the sensor detecting a second predetermined temperature of fluid in the first chamber.

3. The invention as set forth in claim 2 further comprising a sensor for detecting the presence of the photosensitive material at the processor, the sensor being coupled to the processor control, and the processor control being operable in response to the sensor detecting the material to open the supply valve to provide fresh water to the second chamber for a predetermined period of time less than the period of time required to process the material.

4. In a processor for a photosensitive material, such as film, the processor having a plurality of chambers for processing the material including a developer chamber for holding a developer fluid and a wash chamber for holding water for washing the material, a pump having an inlet and an outlet, the pump being effective to remove water from the wash chamber and recirculate the water to the wash chamber, means for providing fresh water from a source of such water to the wash chamber including a solenoid operated valve so that when the valve is opened water from the source can be delivered to the wash chamber, and a heat exchanger having an inlet and an outlet, the improvement comprising:

a diverter valve located between the outlet of the pump and the wash chamber, the diverter valve having an inlet connected to the outlet of the pump and first and second outlets, the first outlet of the diverter valve being connected to the wash chamber so that water from the pump can be provided directly to the wash chamber, the second outlet of the diverter valve being connected to the inlet of the heat exchanger with the outlet of the heat exchanger being coupled to the wash chamber, a temperature sensor located with respect to the developer chamber for detecting the temperature of the developer in the chamber, and a processor control coupled to the pump, the solenoid control valve, the diverter valve and the temperature sensor, the processor control being programmed (1) to close the solenoid valve and position the diverter valve to recirculate water from the wash chamber through the pump and the first outlet of the diverter valve directly back to the wash chamber when the sensor detects a developer temperature below a first predetermined minimum temperature, (2) to position the diverter valve to circulate water from the second outlet of the diverter valve to the heat exchanger when the sensor detects a developer temperature above the minimum temperature to effect cooling of the developer fluid, and (3) to open the solenoid valve to provide water to the wash chamber when the sensor detects a second predetermined developer temperature above the minimum temperature.

5. The invention as set forth in claim 4, wherein the wash chamber comprises a pair of tubes of rectangular cross section connected to the first outlet of the diverter valve and the outlet of the heat exchanger, the tubes being located on opposite sides of a path for the material through the wash chamber and having openings for discharging water from the tubes directly onto the material.

* * * * *